US005842927A

United States Patent [19]

Rieber

[11] Patent Number: 5,842,927

[45] Date of Patent: Dec. 1, 1998

[54] CHILDREN'S SLIDE WITH INTEGRAL RACEWAYS

[75] Inventor: Fred Rieber, Alum Bank, Pa.

[73] Assignee: Hedstrom Corporation, Bedford, Pa.

[21] Appl. No.: 959,022

[22] Filed: Oct. 28, 1997

[51] Int. Cl.[6] ..... A63G 21/04

[52] U.S. Cl. ..... 472/116; 472/89; 104/69

[58] Field of Search ..... 472/116, 117, 472/88, 89; 104/69, 70

[56] References Cited

U.S. PATENT DOCUMENTS

| | | | |
|---|---|---|---|
| 4,865,311 | 9/1989 | Beekenkamp | 472/116 |
| 5,728,005 | 3/1998 | Rothhard | 472/116 |

*Primary Examiner*—Kien T. Nguyen
*Attorney, Agent, or Firm*—Cesari and McKenna, LLP

[57] ABSTRACT

A children's slide has an elongated trough supported in an inclined position. The trough includes side walls which not only help to guide children down the slide, but also define inclined raceways for toy cars or the like which children can race down the slide.

8 Claims, 1 Drawing Sheet

CHILDREN'S SLIDE WITH INTEGRAL RACEWAYS

This invention relates to children's playground and play gym equipment. It relates especially to children's slides.

BACKGROUND OF THE INVENTION

A slide is a well known children's toy. Basically, the slide consists of an elongated channel or trough, one end of which is supported above the ground by a suitable support structure such as a platform with ladder, swing set, climbing tower, etc., and the other end of which is located close to ground level. The angle of declination of the slide is such that when a child launches him/herself onto the upper end of the slide, the child will slide down under gravity to the lower end of the slide. Present day slides may also include curves or undulations to make the slide ride more exciting for the child.

Over time, however, a child may loose interest in the slide because of its relatively narrow field of use. Therefore, it would be desirable if a children's slide were to be developed which could be used for more than one purpose.

SUMMARY OF THE INVENTION

Accordingly, the present invention aims to provide an improved children's slide.

Another object of the invention is to provide such a slide which has sliding surfaces for both children and toy vehicles.

Still another object of the invention is to provide a children's slide which has complimentary functions.

Still another object of the invention is to provide a children's slide which increases the riders' enjoyment.

Other objects will, in part, be obvious and will, in part, appear hereinafter.

The invention accordingly comprises the features of construction, combination of elements and arrangement of parts which will be exemplified in the following detailed description, and the scope of the invention will be indicated in the claims.

In general, my slide includes the usual elongated channel or trough supported in an inclined position. The slide has side walls which not only help to guide children down the slide, but also function as inclined raceways for toy cars, sleds or the like which the children can race at the same time the children are using the slide.

As will be seen, the slide with integral raceways may comprise a single, molded plastic part which can be made in quantity relatively inexpensively. Therefore, the slide should find wide use in backyards and playgrounds where children are normally at play.

BRIEF DESCRIPTION OF THE DRAWINGS

For a fuller understanding of the nature and object of the invention, reference should be had to the following detailed description taken in connection with the accompanying drawings, in which.

DETAILED DESCRIPTION OF AN ILLUSTRATIVE EMBODIMENT

Figure 1:
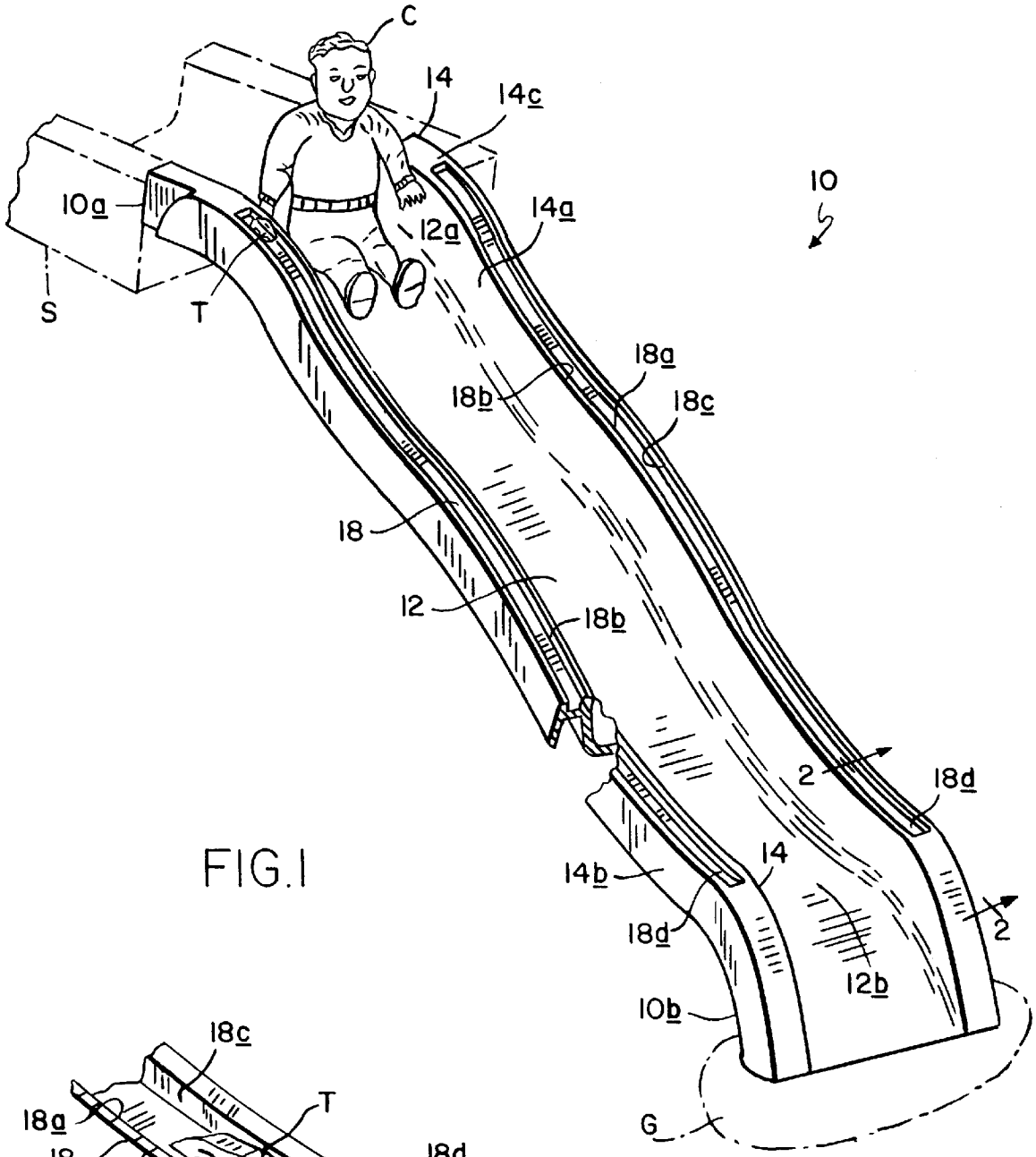
FIG. 1 is a perspective view of a children's slide incorporating the invention.

Referring to FIG. 1 of the drawings, the subject slide, shown generally at 10, is an elongated trough-like structure having an upper end 10*a* supported above the ground by a support structure S. The support structure may be a platform with a ladder leading to the platform or it may be a part of a play gym or a climbing tower of the type disclosed in patents U.S. Pat. Nos. Des. 363,521 and Des. 372,065, for example. The opposite or lower end 10*b* of slide 10 curves downward and may either rest on ground G or be supported by an appropriate support (not shown) so that the slide lower end 10*b* is spaced above the ground to some extent.

Preferably, slide 10 is a unitary part molded of a suitable rigid, weather-resistant plastic such as, for example, high-density polyethylene.

Slide 10 has an undulating trough-like bottom wall 12 constituting a slide surface and whose upper end 12*a* is normally more or less horizontal to form a seating platform for a child C. The lower end 12*b* of wall 12 is spaced above ground G so that when a child exits the inclined wall 12 in a sitting position, his/her feet can touch the ground.

Extending up at opposite sides of bottom wall 12 is a pair of mirror-image side walls 14 each having an inverted U-shaped crossection thereby forming a pair of full length channels at opposite sides of the slide which greatly rigidify the slide. In particular, each wall 14 includes an inboard, generally vertical wall 14*a*, an outboard generally vertical wall 14*b* and a top wall 14*c* connecting walls 14*a* and 14*b*. Preferably, the top wall 14*c* follows any undulations in the slide bottom wall 12*a*.

In accordance with the invention, a raceway 18 is formed in the top wall 14*c* of each slide side wall 14. Preferably, each raceway extends from a location adjacent to the upper end 12*a* of the slide bottom wall 12 to the exit end 12*b* of that wall, following any curves or undulations in wall 12*a*. Each raceway 18 is basically a depression having a bottom wall 18*a* which has a relatively smooth, even surface and inner and outer side walls 18*b* and 18*c*, respectively which extend up from the corresponding bottom wall 18*a*. Each raceway 18 thus defines a racing track for a toy car T which may be positioned in the raceway 18 at the top of the slide and roll down the raceway to the bottom of the slide.

Figure 2:
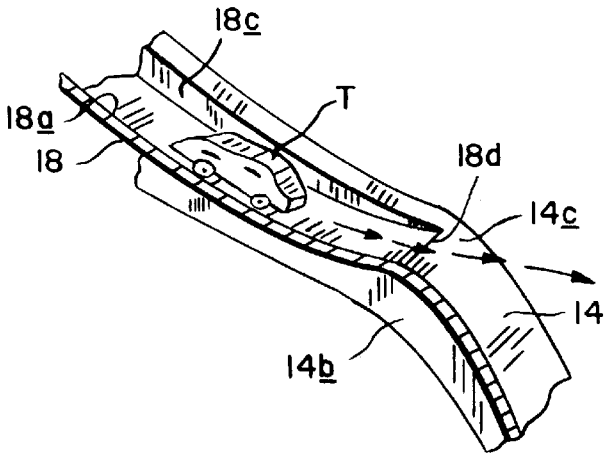
FIG. 2 is a sectional view on a larger scale taken along line 2—2 of FIG. 1.

Preferably, as shown in FIG. 2, the lower end 18*d* of each raceway at the bottom of slide 10 is shaped so that the raceway bottom wall 18*a* is more or less even with the top wall 14*c* of the corresponding slide side wall 14 so that there is nothing to prevent the toy T from leaving a raceway 18 and being launched into the air adjacent to the lower end 12*b* of wall 12.

To use the slide 10, a child C climbs to the upper end of the slide and sits down on the upper end 12*a* of the slide wall 12. If the child has a toy car, the car may be positioned at the upper end of one of the raceways 18 as shown at the upper end of slide 10 in FIG. 1. The child may then release the car and watch it roll down the raceway and be launched into the air at the lower end of the raceway as indicated in FIG. 2.

Of course, the child could also position two toy cars T on the two raceways 18 of slide 10 and allow the two cars to race each other down the slide. To add even further enjoyment, the child could launch him/herself down the slide at the same time the toy cars are released and thus race the cars down the slide. Thus, the slide side walls 14 not only guide the child down the slide, they, or more particularly, their portions forming the raceways 18 also guide toy cars down the slide. Thus, the slide performs more or less the same function for both children and toy vehicles simultaneously.

As noted above, slide 10 may be a simple molded plastic part which can be made in quantity relatively inexpensively.

Indeed, a slide 10 with the integral raceways 18 should cost no more to make that prior comparable children's slides which do not have integral raceways for toy cars. Therefore, my invention should increase the marketability of children's slides.

It will thus be seen that the objects set forth above, among those made apparent from the preceding description, are efficiently attained and, since certain changes may be made in the above construction without departing from the scope of the invention, it is intended that all matter contained in the above description or shown in the accompanying drawings shall be interpreted as illustrative and not in a limiting sense.

It will also be understood that the following claims are intended to cover all of the generic and specific features of the invention described herein.

What is claimed is:

1. A children's slide comprising an elongated trough having a slide bottom wall with opposite ends and a pair of opposite slide side walls extending up from the slide bottom wall to slide top walls, and an unobstructed raceway in at least one of the slide top walls, each raceway including a raceway bottom wall having a substantially straight transverse crossection, and upper end wall extending up from the raceway bottom wall to the corresponding slide top wall and a pair of raceway side walls extending up from the raceway bottom wall to the corresponding slide top wall so as to define an elongated racing track for a toy vehicle.

2. The slide defined in claim 1 wherein a raceway is present in each of said slide top walls.

3. The slide defined in claim 1 and further including means for supporting one end of the slide bottom wall at an elevated position relative to the other end of the slide bottom wall.

4. A children's slide as defined claim 1 wherein the raceway bottom wall has one end flush with the corresponding slide top wall.

5. A children's slide comprising a pair of elongated parallel channels, each channel having a generally inverted U-shaped crossection composed of inner and outer side walls connected by a top wall;

a slide surface having opposite ends and connecting said inner side walls so that the channels constitute side walls for said surface;

an elongated depression in the top wall of at least one of said channels said depression having opposite ends and defining a racing track for a toy vehicle.

6. The slide defined in claim 5 wherein a depression is present in the top wall of each of said channels.

7. The slide defined in claim 5 wherein each depression extends substantially the entire length of the corresponding channel.

8. The slide defined in claim 5 wherein the depression has one end flush with the top wall of the corresponding channel.

* * * * *